US008997756B2

(12) United States Patent
Haynes

(10) Patent No.: US 8,997,756 B2
(45) Date of Patent: Apr. 7, 2015

(54) SCALP SOOTHER

(71) Applicant: Crystal Ann Haynes, Bellflower, CA (US)

(72) Inventor: Crystal Ann Haynes, Bellflower, CA (US)

( * ) Notice: Subject to any disclaimer, the term of this patent is extended or adjusted under 35 U.S.C. 154(b) by 0 days.

(21) Appl. No.: 13/869,540

(22) Filed: Apr. 24, 2013

(65) Prior Publication Data

US 2013/0276806 A1 Oct. 24, 2013

Related U.S. Application Data

(60) Provisional application No. 61/637,678, filed on Apr. 24, 2012.

(51) Int. Cl.

| | |
|---|---|
| ***A45D 24/02*** | (2006.01) |
| ***A45D 19/02*** | (2006.01) |
| ***A45D 24/22*** | (2006.01) |
| *A45D 19/00* | (2006.01) |

(52) U.S. Cl.

CPC ..... *A45D 24/02* (2013.01); *A45D 19/02* (2013.01); *A45D 24/22* (2013.01); *A45D 2019/0033* (2013.01)

(58) Field of Classification Search

USPC ..... 132/112–114, 120, 121, 150

See application file for complete search history.

(56) References Cited

U.S. PATENT DOCUMENTS

| | | | | |
|---|---|---|---|---|
| 804,522 | A * | 11/1905 | Delroy | 132/109 |
| D51,625 | S | 12/1917 | Alexis | |
| D67,703 | S | 6/1925 | Jacobs | |
| D67,704 | S | 6/1925 | Jacobs | |
| 1,574,418 | A * | 2/1926 | Coviello | 601/154 |
| 1,586,031 | A | 5/1926 | William | |
| 2,636,498 | A | 4/1953 | Servilla | |
| 3,292,641 | A | 12/1966 | Quintanar | |
| 3,768,463 | A | 10/1973 | Curry | |
| D266,278 | S | 9/1982 | Daddons, Jr. | |
| D282,911 | S * | 3/1986 | Nigro | D9/434 |
| 5,285,774 | A | 2/1994 | Stachurski | |
| 5,655,257 | A | 8/1997 | Chavez | |
| 5,937,526 | A | 8/1999 | Wahl et al. | |
| D423,718 | S | 4/2000 | Shih-Ming | |
| 6,457,476 | B1 | 10/2002 | Elmer et al. | |
| D481,168 | S | 10/2003 | Shannon | |
| D495,089 | S | 8/2004 | Tomaro | |
| 6,997,889 | B1 | 2/2006 | Thomas | |
| 7,013,900 | B2 | 3/2006 | Silva | |
| D593,710 | S | 6/2009 | Wise et al. | |
| D601,751 | S | 10/2009 | Day | |
| D667,997 | S | 9/2012 | Stewart | |

(Continued)

OTHER PUBLICATIONS https://www.facebook.com/weaverscratcher; The Weave Scratcher retrieve on retrieved Feb. 7, 2014, 7 pages.

(Continued)

*Primary Examiner* — Rachel Steitz

(74) *Attorney, Agent, or Firm* — Fish & Richardson P.C.

(57) ABSTRACT

Embodiments pertain to a scalp care device. The scalp care device includes a handle extended along a longitudinal axis and a set of curved teeth that extend along the longitudinal axis. The teeth are curved so as to facilitate sliding the teeth underneath a user's hair so that the tips of the teeth reach the user's scalp and can manipulate the scalp so as to provide care for it. The curved teeth are joined to the handle by a bridge region. In one embodiment, the teeth are hollow and the handle includes a bottle for holding liquid, such that the liquid may flow through the teeth to be deposited upon the scalp.

20 Claims, 6 Drawing Sheets

(56) References Cited

U.S. PATENT DOCUMENTS

| | | | |
|---|---|---|---|
| D669,217 | S | 10/2012 | Hsu |
| D674,136 | S | 1/2013 | Stewart |
| 8,342,188 | B2 | 1/2013 | Pabari et al. |
| 8,678,017 | B2 | 3/2014 | Arpey et al. |
| 2004/0097890 | A1 | 5/2004 | Wilkinson |
| 2011/0108048 | A1 | 5/2011 | Park |
| 2011/0245811 | A1 | 10/2011 | Sabal |
| 2012/0121313 | A1 | 5/2012 | Thiebaut |
| 2012/0288351 | A1 | 11/2012 | Nirmel |
| 2013/0042880 | A1 | 2/2013 | Arpey et al. |

OTHER PUBLICATIONS http://www.weavescratcher.com, The Weave Scratcher retrieved on Feb. 7, 2014, 2 pages.
http://www.jesrestaurantequipment.com/product.asp?itemid=18138&utm_source=google shopping&gclid=CjgKEAjwn-WcBRD61NHM-uqDrm4SJADrP4tPKsIwTV-FViBaOLVok-bv2ptcGL75d6fz5Ez5RfiM5vD_BwE; JES Restaurant Equipment Turkey Lifter Forks retrieved on Jun. 16, 2014, 7 pages.
http://www.bedbathandbeyond.com/store/product/all-clad-turkey-forks-set-of-2/1014120831?Keyword=fork; Bed Bath & Beyond All-Clad Turkey Forks, retrieved on Jun. 16, 2014, 3 pages.
http://www.kohls.com/product/prd-1603950/Charcoal-Companion-2-pc-Meat-Claw-Lifter-Set.jsp?ci_mcc=ci&srccode=cii_17588969&cpncode=34-198018654-2&CID=shopping15; Charcoal Companion C1130 Stainless Meat Claws Lifter-Meat Shredder, retrieved on Jun. 16, 2014; 3 pages.
http://www.lakeland.co.uk/10328/Roast-Lifting-Forks, Roast Lifting Forks, retrieved on Jun. 6, 2014, 2 pages.
http://www.amazon.com/Grip-Ez-Meat-Fork-handle-Steel/dp/B001T7HZ2O/ref=sr_1_4?s=kitchen&ie=UTF8&qid=1402868373&sr−1-4, Meat Fork, retrieved on Jun. 16, 2014, 3 pages.
Office Action in U.S. Appl. No. 29/453,033, dated Nov. 19, 2014, 10 pages.

* cited by examiner 412
414
410
400
420
430
432D
434D
432C
434C
432B
434B
434A
432A

SCALP SOOTHER

CROSS-REFERENCE TO RELATED APPLICATIONS

This application claims the benefit of U.S. Provisional Application No. 61/637,678 filed Apr. 24, 2012, which is incorporated herein in its entirety by reference.

FIELD

This specification describes technologies related to scalp care.

BACKGROUND

As individuals style their hair in different ways, or use artificial hair or hair attachments such as weaves or wigs, various issues and problems for those individuals' scalps may develop. For example, scalps may be itchy, may have issues with blood circulation, or may residue may be trapped between the hair and the scalp.

SUMMARY

The devices described herein provide a way to manipulate the scalp for relief while minimizing the impact on natural hairstyles, weaves, and wigs. Certain embodiments additionally provide an effective way to distribute fluids directly to the scalp while minimizing the impact on natural hairstyles and on artificial weaves or wigs. Embodiments incorporate a handle that makes it easy to hold the device, as well as teeth that are curved and shaped so as to facilitate sliding the teeth under natural or artificial hair so that it is easy to position the tips of the teeth in a way that touches the scalp and can stimulate the scalp in a helpful way.

In general, one innovative aspect of the subject matter described in this specification can be embodied in a device including a handle portion formed of an elongated piece of material, the handle portion being extended along a longitudinal axis; a tooth portion, comprising a plurality of teeth, wherein all of the teeth extend along the longitudinal axis, are of the same length, and the teeth are curved; and a bridge portion, joining the handle portion to the teeth, wherein the bridge portion broadens as it extends, along the longitudinal axis, from the handle portion.

Another innovative aspect of the subject matter described in this specification can be embodied in a device a handle portion formed of an elongated, flat piece of material, the handle portion being shaped to be held by one hand of a user; a bridge portion, extending from the handle portion, wherein the bridge portion broadens as it extends from the handle portion, the bridge portion being formed of a flat piece of material that is in the same plane as the handle portion, the bridge portion extending beyond the grip of a user when a user holds the device by the handle portion; and a tooth portion, extending from the bridge portion and comprising a plurality of teeth, wherein all of the teeth are of the same length and the teeth are curved with a contour that substantially conforms to the curvature of the top of a human head.

Yet another innovative aspect of the subject matter described in this specification can be embodied in a device including a handle portion formed of an elongated piece of material, the handle portion being extended along a longitudinal axis, the handle containing a cavity that is filled with a liquid to be conveyed to a user's scalp; a tooth portion, comprising a plurality of teeth, wherein all of the teeth extend along the longitudinal axis, are of the same length, and the teeth are curved, and the teeth are hollow and the tips of the teeth have openings; and a bridge portion, joining the handle portion to the teeth, wherein the bridge portion broadens as it extends, along the longitudinal axis, from the handle portion, and wherein the bridge portion contains an orifice that allows fluid form the cavity to flow through the orifice through the openings at the tips of the teeth.

These and other embodiments may each optionally include one or more of the following features. In some embodiments, the handle portion and the bridge portion are formed of a single, continuous planar piece of material. In some embodiments, each tooth extends a distance from the bridge portion in the direction of the longitudinal axis that is least as long as the handle portion. In some embodiments, all of the teeth are substantially parallel. In some embodiments, the teeth are separated by gaps such that the teeth are substantially narrower than the gaps. In some embodiments, the material used in the handle portion, the bridge portion, and the tooth portion is all of approximately the same thickness and that thickness is approximately the same as the width of the teeth. In some embodiments, the tips of the teeth are narrower than the width of the teeth at the points from which the teeth extend from the bridge region. In some embodiments, the curvature of each tooth is substantially similar to an elliptical arc, wherein the major axis of the elliptical arc is oriented in the direction of the teeth. In some embodiments, the curvature of each tooth is substantially similar to a truncated elliptical arc, wherein the major axis of the elliptical arc is oriented in the direction of the teeth. In some embodiments, the teeth are curved such that the ends of the teeth are positioned above the plane of the bridge portion and the handle portion. In some embodiments, the teeth are curved such that the ends of the teeth are positioned at or below the plane of the bridge portion and the handle portion. In some embodiments, the device has an axis of symmetry in the middle of the device that is parallel to the direction in which the teeth extend from the bridge portion. In some embodiments, the handle portion provides a firm gripping region for a user to hold the scalp scratching device. In some embodiments, the teeth are positioned such that when inserted underneath a mass of hair, the ends of the teeth may be moved to stimulate the scalp in a manner that relieves irritation. In such an embodiment, the movement of the ends of the teeth occurs in a direction that is parallel to the direction in which the teeth extend from the bridge portion. In some embodiments, the tips of the teeth are rounded to facilitate penetration by the teeth underneath natural or artificial hair. In some embodiments, the teeth are tapered to facilitate penetration by the teeth underneath natural or artificial hair. In some embodiments, the width of the teeth and the gaps between teeth are sized to facilitate penetration underneath the teeth of natural or artificial hair. In some embodiments, the curvature conforms to the curvature of the top of a human head to facilitate sliding underneath a mass of natural or artificial hair by the teeth.

Particular embodiments of the subject matter described in this specification can be implemented so as to realize one or more of the following advantages. Embodiments provide a way to deal with the challenge posed by the difficulty of reaching the surface of a user's scalp if the scalp is blocked by a mass of natural or artificial hair. Embodiments provide for different types of teeth that are curved in a manner so as to easily slide under a user's hair and touch the scalp directly, under the hair. By moving the tips of the teeth against the scalp, it becomes possible to relieve itching, increase blood circulation to the scalp, and help dislodge or remove residue. Furthermore, the teeth are designed to avoid injuring the scalp. Furthermore, the handle portion is shaped in a way that makes it easy to hold the device and move the ends of the teeth to care for the user's scalp, and the bridge portion joins the tooth portion to the handle portion in a way that makes it easy to position and guide the tips of the teeth in a way that is beneficial to the scalp. Other embodiments offer the additional advantage of providing a convenient way to deliver liquids to the user's scalp without interfering with existing natural or artificial hair of the user.

The details of one or more embodiments of the subject matter described in this specification are set forth in the accompanying drawings and the description below. Other potential features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Hair weaves and hair extensions are done by braiding the wearer's natural hair flat to their head and sewing artificial hair to the braids. This is done for thickness, length and to wear a different texture of hair. Because the hair is braided and the hair is sewn on, it is hard to scratch and massage the scalp. Alternatively, various hairstyles may make it difficult for the person with that hairstyle to reach theft scalp. Whether due to artificial hair, such as a hair weave, extension, or wig, or due to a natural hairstyle, the hair may create a barrier around the scalp that is difficult to penetrate.

Thus, those individuals with hair that blocks access to their scalps would like to be able to manipulate their scalps so as to be able to relieve and address these problems. Furthermore, the individuals would like to be able to manipulate their scalps without disrupting a natural hairstyle or artificial weaves or wigs.

Individuals can use elongated implements, such as a pick, to attempt to reach and manipulate their scalps. However, these elongated implements are straight and are directed to reach the scalp by piercing through a hairstyle, which may disrupt the hairstyle.

However, there are multiple reasons why a user with such an arrangement of hair might want to manipulate their scalp. For example, the scalp might get itchy or irritated. Alternatively, there might be dandruff or residue that the user would like to dislodge. To address such problems, the user might want to rub or otherwise stimulate points on the scalp, either to relieve itch and irritation or to help dislodge dandruff or residue. Alternatively, the user might want to apply a liquid, such as a cleaning agent to the scalp to help care for it.

However, current technology is not well adapted to care for a user's scalp in the above scenarios because current approaches are not adapted to help the user reach areas on their scalp without disturbing the user's natural or artificial hairstyle.

In general, embodiments are curved to the shape of the user's head allowing the user better control to scratch and massage without disturbing hair weaves and hair extensions. Thus, embodiments help address some of the issues noted above.

Embodiments are designed to conform to the user's head-shape. For example, a user may insert the device through and/or under a hair weave or hair extensions or their natural hairstyle to scratch and massage the scalp without disturbing the hair itself. Instead of using Bobbie pins, styling combs and other items not designed to be inserted through the weave to scratch and massage that are too small and are not shaped to get the best results, embodiments advantageously include a number of structural features that improve their ability to help manage scalp issues without disturbing hair arrangements.

Various embodiments will now be discussed in connection with the drawings to explain their operation.

Figure 1:
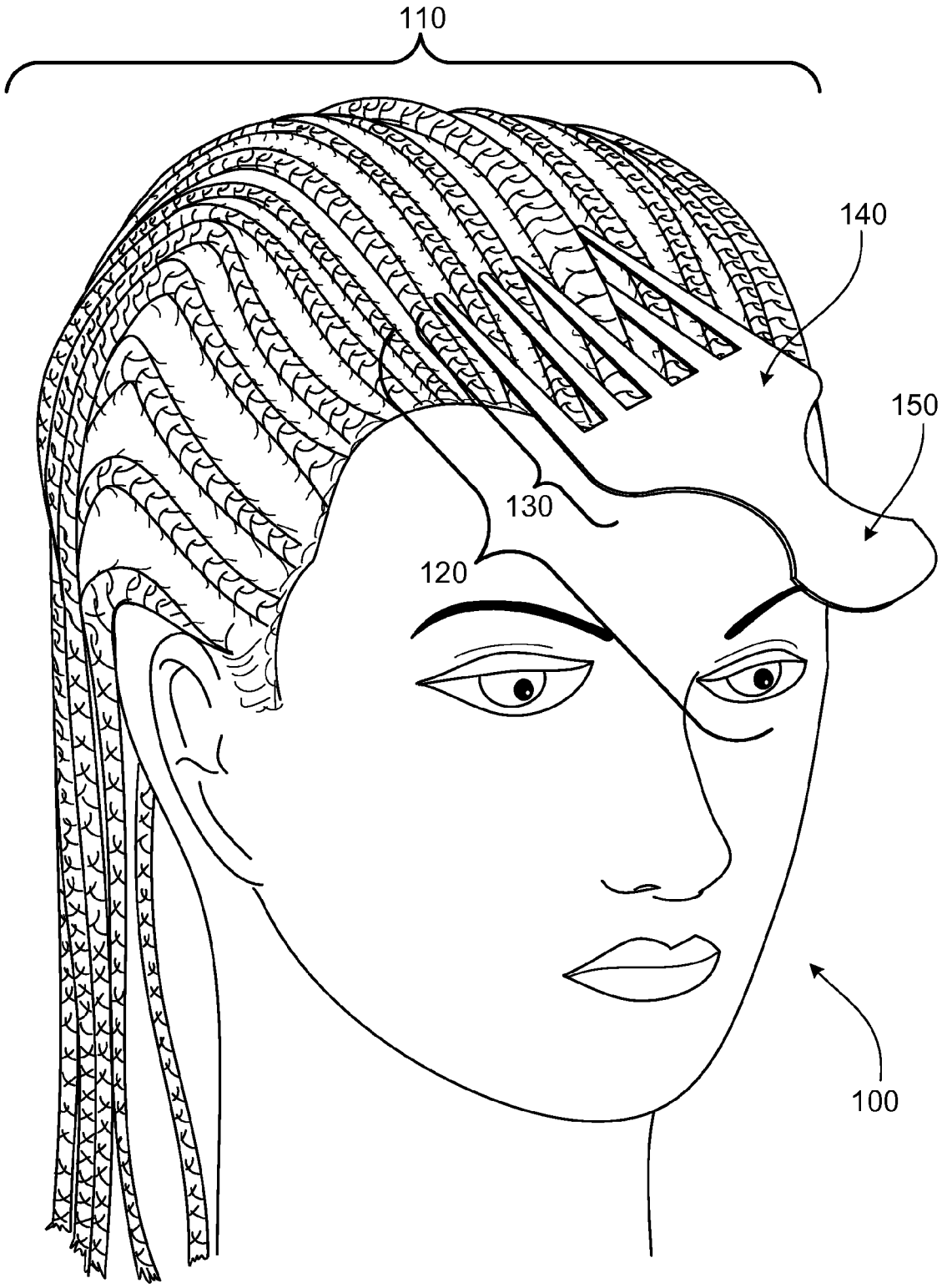
FIG. 1 illustrates use of a scalp care device with straight teeth.

FIG. 1 illustrates use of a scalp care device with straight teeth. The illustration provides a view of a user 100. The user has a hair arrangement 110 that makes it difficult to reach the user's scalp. As discussed, previously, hair arrangements 110 may include a number of different natural and artificial hair arrangements that block access to the user's scalp. For example, hair arrangements 110 may include very tightly wound braids, or sheets of hair in hair extensions that otherwise block access to the user's scalp. FIG. 1 illustrates an attempt by the user to reach his or her scalp and relieve irritation with a scalp care device 120 that has flat teeth 130. Scalp care device 120 has a handle 150 joined to teeth 130 by a bridge portion 140, the teeth 130 extending from bridge portion 140. FIG. 1 shows the difficulty of manipulating the scalp with teeth 130 because teeth 130 are straight. While handle 150 is appropriate to be held in a user's hand (not shown) to provide a grip for scalp care device 120 to manipulate scalp care device 120, because teeth 130 are straight, even if scalp care device 120 is directed to penetrate hair arrangements 110, it does not curve with the scalp, so if scalp care device 120 is placed under hair arrangements 110, it simply penetrates through hair arrangements 110 and teeth 130 are not able to meaningfully reach the scalp surface, especially the part of the scalp surface that is thoroughly buried underneath hair arrangements 110. Thus, FIG. 1 illustrates that a scalp care device 120 with straight teeth 130 is not well-adapted to reach the scalp, especially central portions of the scalp that are removed from the edges of hair arrangements 110.

Figure 2:
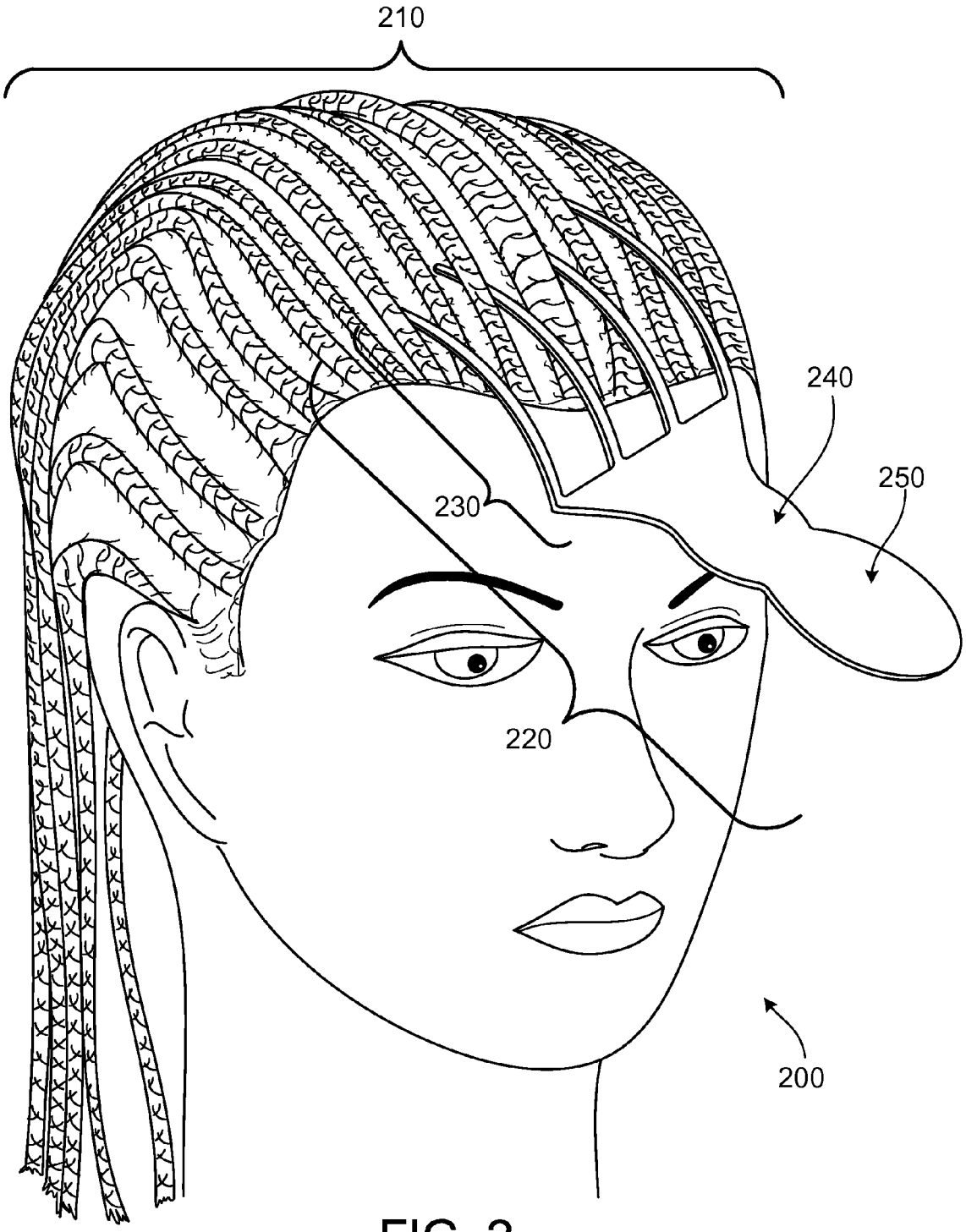
FIG. 2 illustrates use of a scalp care device with curved teeth.

FIG. 2 illustrates use of a scalp care device with curved teeth. User 200 is analogous to user 100 of FIG. 1, having hair arrangements 210 that are analogous to hair arrangements 110 of FIG. 1. Similarly, user 200 uses scalp care device 220, with teeth 230, bridge portion 240, and handle portion 250. FIG. 2 illustrates teeth 230 that are curved in a way that is similar to the curvature of the top of the head of user 200. Because of the curvature, handle portion 240 may be planted on head of user 200, and teeth 230 curves along the scalp, sliding underneath hair arrangements 210. Advantageously, the tips of teeth 230 are able to contact the scalp, but because teeth 230 are curved so as to slide along the scalp, the teeth are able to make contact with the scalp without disrupting hair arrangements 210.

In the context of FIG. 2, embodiments work such that a user lifts a portion of his or her hair up and inserts the device under his or her hair so that the tips of the teeth contact his or her scalp. Once the teeth are in place, the user may move the teeth back and forth to soothe itching and massage the scalp and/or dislodge residue.

Figure 3A:
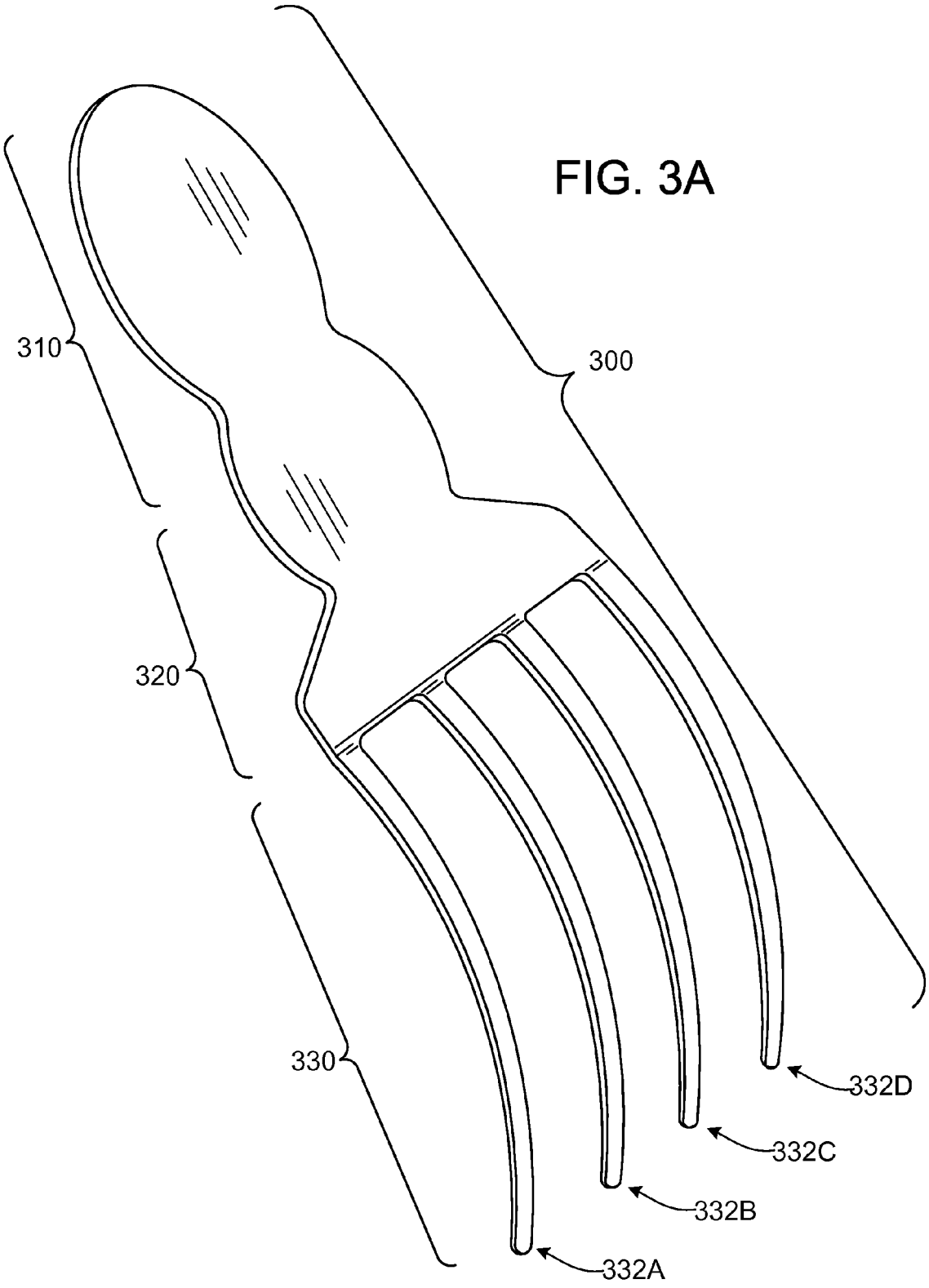
FIGS. 3A-3C are three views that illustrate a scalp care device with curved teeth.
Figure 3B:
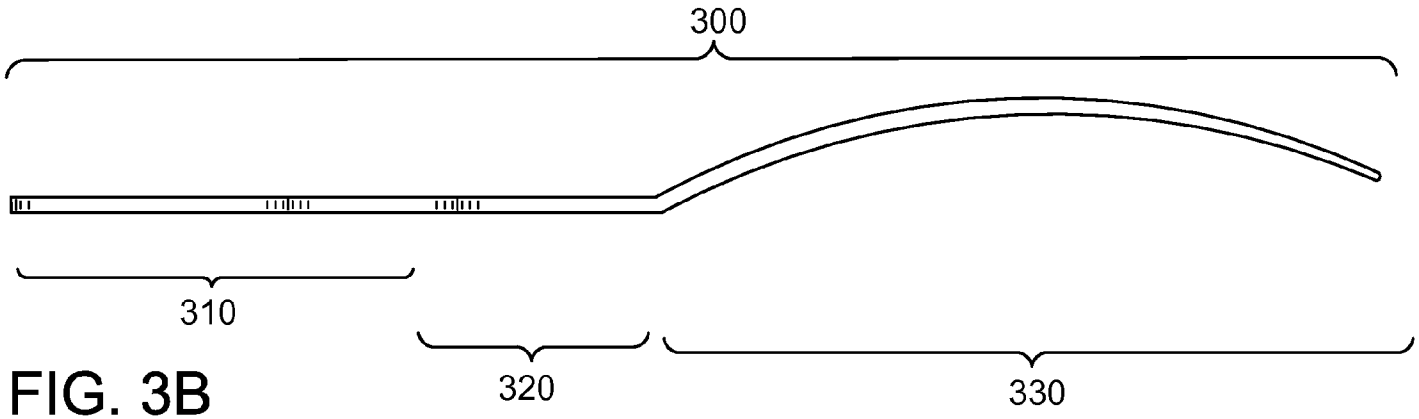
Figure 3C:
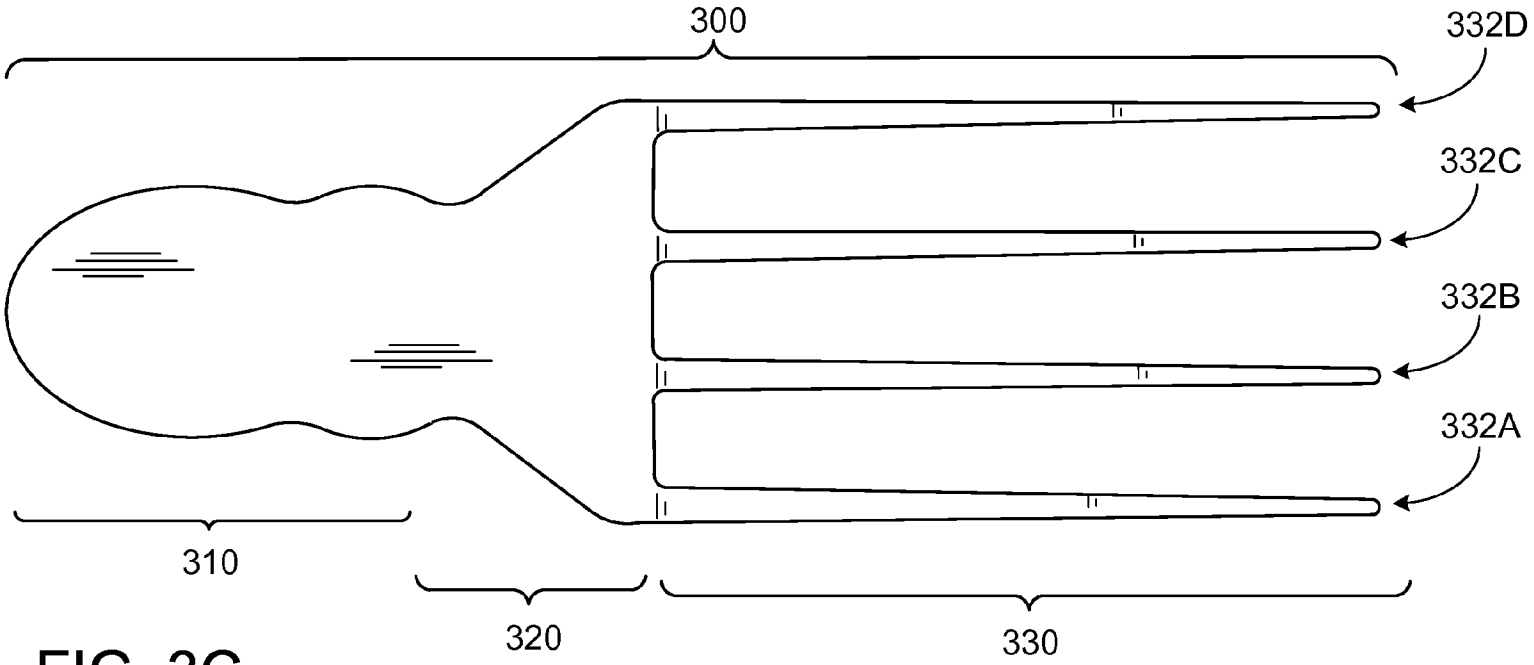

FIGS. 3A-3C are three views that illustrate a scalp care device with curved teeth.

Scalp care device 300 may be manufactured by making a mold of the design, and constructing the device as a piece of a strong plastic. The plastic may be flexible or inflexible. Additionally, multiple plastics may be used for different parts of the device. For example, the teeth may be formed of a more malleable plastic than the handle. It may also be noted that all or part of the device can be formed of other hard, solid materials, such as rubber, wood, metal, glass, or ceramics. The surface of the device may also be coated with a smooth coating that improves the ability of the teeth to slide through and under natural or artificial hair. Similarly, it is possible to dip the teeth in a lubricant or solution that help the teeth slide through and under natural or artificial hair.

It is possible to construct variants of the device with different curvatures, spacing, and lengths of the teeth for different users. It is also possible for a user to customize an embodiment by cutting off portions of the teeth or molding them to customize that embodiment for their personal use by improving the degree of fit.

Scalp care device 300 comprises three main regions: handle portion 310, bridge portion 320, and tooth portion 330.

FIGS. 3A-3C illustrate various views of scalp care device 300. The embodiment illustrated in the figures shows that handle portion 310 is formed of an elongated piece of material with a longitudinal axis, such that handle portion 310 provides an area that is designed to provide a convenient grip for scalp care device 300. In general, scalp care device 300 is designed to be held in one hand of a user. In the illustrated embodiment, scalp care device 300 is symmetrical about its longitudinal axis, and hence handle portion 310 is adapted equally to be held in the left or right hand of a user. However, other embodiments may have a handle portion 310 that is asymmetrical so as to adapt the handle so as to be better suited to be held by a left-handed user, or be better suited to be held by a right-handed user.

FIGS. 3A-3C also illustrate other aspects about handle portion 310, in an embodiment. The illustrated embodiment includes a bulbous region at the end of handle portion 310, which continues into a second bulbous region before handle portion 310 joins into the bridge portion. The second bulbous region is designed to help a user have a firm grip on the device. Additionally, FIG. 3A and FIG. 3B illustrate that handle portion may be formed of a flat sheet of material that is of a constant thickness throughout handle portion, as illustrated in FIG. 3B. As shown in FIG. 3B, the material is generally formed as a fairly thin sheet, but should be sufficiently thick so as not to be easily breakable. For example, the thickness of the sheet may be one to five millimeters.

Handle portion may have a wide variety of shapes that help a user to grip the device. While FIGS. 3A-3C illustrate a shape with two bulbs, many other shapes are possible. In order to act in the role of handle portion 310, the handle needs to be sufficiently long and wide to be gripped by a human hand. However, a wide variety of shapes of material may serve as handle portion 310 in various embodiments. The material may have flat edges, rounded edges, or a combination, and it need not necessarily be symmetrical. In general, the longitudinal axis of the handle portion should be five to ten centimeters in length, but longer or shorter handle portions 310 may be possible depending on the shape of bridge portion 320 and tooth portion 330. In general, while the width may vary, the handle portion should be two to five centimeters wide to facilitate an easy grip.

Additionally, handle portion need not necessarily be formed of a thin sheet of material. While forming the handle portion of a thin sheet of material makes it simple and inexpensive to manufacture the handle portion, the handle portion can be formed in a wide variety of ways. The handle portion may have a curved or angled top or bottom surface, or may have a complicated three-dimensional configuration that helps it act as a grip. For example, the handle portion may have a rounded bottom, and may have multiple grooves on its top surface that are designed to facilitate a firm grip on the handle by a user's fingers. Another aspect of the handle portion, in which it includes a cavity holding fluids, is discussed in connection with FIGS. 4A-4C.

FIGS. 3A-3C also illustrate bridge portion 320. The role of bridge portion 320 is to join handle portion 310 to tooth portion 330. FIGS. 3A-3C illustrate a bridge portion 320 that is situated at the end of handle portion 310 and is formed of a sheet of material that is substantially parallel to that of handle portion 310. FIGS. 3A and 3C show that bridge portion 320 in the illustrated embodiment gradually broadens from where bridge portion 320 joins to handle portion 310 to a greater width at the point from which the teeth originate from the bridge portion 320. For example, the bridge portion 320 may broaden from a width that is as little as two centimeters to a width that is as great as eight to ten centimeters. In the embodiment shown in FIGS. 3A-3C, it can be seen that bridge portion 320 is flat and lies in the same plane as handle portion 310. This flat embodiment works well because the end of bridge portion 320 can be planted along the user's scalp as the user holds bridge portion 320 in contact with the scalp by handle portion 310 and tooth portion 330 has teeth that curve substantially in conformance with the curvature of the scalp. However, some embodiments may include bridge portion 320 that has curvature or is at an angle with respect to handle portion 310. Also, some embodiments may have a bridge portion 320 that is not composed of a flat sheet. For example, bridge portion may be thicker than handle portion 310, or thinner. It may also have complex three-dimensional structure. A particular type of such structure will be discussed in connection with FIGS. 4A-4C, below, in which bridge portion includes hollow channels to convey fluid to the scalp.

Tooth portion 330 comprises a plurality of teeth. For example, the plurality of teeth may include four teeth 332A-332D. FIG. 3B does not provide a view of the teeth, as FIG. 3B presents an embodiment in which all of the teeth have the same curvature, and hence the side view presented in FIG. 3B does not show the teeth separately. FIGS. 3A and 3B illustrate that the teeth are curved. While various aspects of the curvature will be discussed in greater detail, below, FIG. 3A shows a scalp care device 300 with four teeth that extend parallel to the longitudinal axis of the handle. FIGS. 3A-3C show an embodiment with four evenly spaced teeth with the same curvature. In general, the teeth will be substantially thinner than the gaps between them. For example, in an embodiment as illustrated, if the bridge portion is five to seven centimeters wide, the teeth might be two to eight millimeters wide where they protrude from the bridge portion, with gaps that are larger than a centimeter. While it is possible to construct an embodiment where the teeth are straight, in general the teeth will have curvature to facilitate reaching the user's scalp without disrupting natural or artificial hair. In various embodiments, the teeth may incorporate additional design features to facilitate their function, which will be discussed below. However, in general, FIGS. 3A-3C illustrates that the tooth portion has a plurality of teeth with a curved shape. FIGS. 3A-3C illustrate four teeth, but in general there is no specific upper or lower limit on the number of teeth, although two to eight teeth will generally work well and it may be helpful to have embodiments with an even number of teeth that are symmetrical about the longitudinal access.

FIGS. 3A-3C illustrate an example embodiment of scalp care device 300. However, other embodiments may incorporate a number of design features so as to help the scalp care device get good results when used.

In some embodiments, the handle portion and the bridge portion are formed of a single, continuous planar piece of material. Such a feature makes it easy to manufacture such a device and easy to hold the device so that the bridge portion is planted on the user's head and the teeth slide underneath the user's hair.

In some embodiments, each tooth extends a distance from the bridge portion in the directions of the longitudinal axis that is least as long as the handle portion. This construction helps the teeth reach parts of the scalp that are difficult to reach otherwise. In some embodiments, all of the teeth are substantially parallel. This construction helps the teeth slide together under the user's hair. In some embodiments, the teeth are separated by gaps such that the teeth are substantially narrower than the gaps. For example, the teeth may be two to four millimeters wide, but may be separated by gaps of a centimeter or more. In some embodiments, the material used in the handle portion, the bridge portion, and the tooth portion is all of approximately the same thickness and that thickness is approximately the same as the width of the teeth. Such a flat planar construction facilitates manufacture and use of the device. In some embodiments, the tips of the teeth are narrower than the width of the teeth at the points from which the teeth extend from the bridge region. Such narrowed teeth tips make it easier for the teeth to penetrate underneath the hair.

In some embodiments, the curvature of each tooth is substantially similar to an elliptical arc, wherein the major axis of the elliptical arc is oriented in the direction of the teeth. Such an elliptical arc may be shaped to conform to a user's head, so as to allow the teeth to slide along a user's head underneath hair. In some embodiments, the curvature of each tooth is substantially similar to a truncated elliptical arc, wherein the major axis of the elliptical arc is oriented in the direction of the teeth. This approach offers similar advantages to an elliptical arc, only part of the downward curvature is not present.

In some embodiments, the teeth are curved such that the ends of the teeth are positioned above the plane of the bridge portion and the handle portion. In some embodiments, the teeth are curved such that the ends of the teeth are positioned at or below the plane of the bridge portion and the handle portion. These approaches affect where the ends of the teeth are with respect to the plane of the bridge portion and handle portion in a way that helps with the usability and effectiveness of the device.

In some embodiments, the device has an axis of symmetry in the middle of the device that is parallel to the direction in which the teeth extend from the bridge portion. Such a symmetrical arrangement allows the device to be used equally well in either hand and makes it easier to position the teeth. In some embodiments, the handle portion provides a firm gripping region for a user to hold the scalp scratching device. By providing this ability, the handle allows the user to position and manipulate the teeth well.

In some embodiments, the teeth are positioned such that when inserted underneath a mass of hair, the ends of the teeth may be moved to stimulate the scalp in a manner that relieves irritation. Such a configuration of the teeth provides the device with its functional properties. In such an embodiment, the movement of the ends of the teeth occurs in a direction that is parallel to the direction in which the teeth extend from the bridge portion. Such a movement direction facilitates scalp relief without disrupting the user's hair.

In some embodiments, the tips of the teeth are rounded to facilitate penetration by the teeth underneath natural or artificial hair. The sides of the teeth may be rounded as well. It is possible for some edges of the teeth to be rounded while others remain flat. Rounded teeth may make it easier to penetrate because the penetration is then more gradual. In some embodiments, the teeth are tapered to facilitate penetration by the teeth underneath natural or artificial hair. Tapering works similarly to rounding, because the penetration is more gradual. In some embodiments, the width of the teeth and the gaps between teeth are sized to facilitate penetration underneath the teeth of natural or artificial hair. For example, the teeth may be kept narrow as discussed above and the gaps kept wide, because narrow teeth with wide gaps need to push less hair out of the way when penetrating beneath the hair.

In some embodiments, the curvature conforms to the curvature of the top of a human head to facilitate sliding underneath a mass of natural or artificial hair by the teeth. As discussed above, it is because the teeth are curved that the ends of the teeth can reach the scalp without interfering with a mass of natural or artificial hair that would otherwise make it difficult to reach the scalp.

Figure 4A:
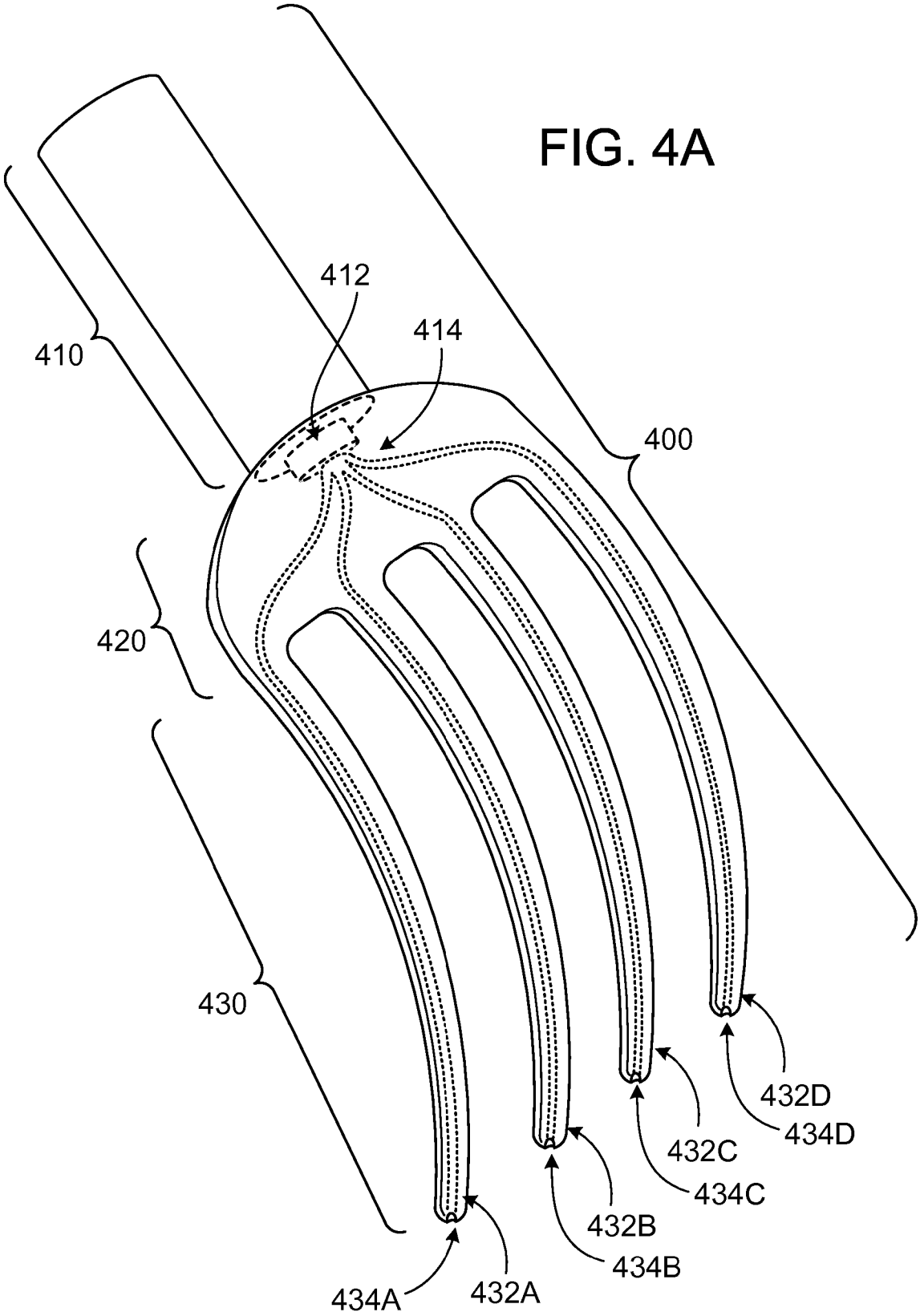
FIGS. 4A-4C are three views that illustrate a scalp care device with curved, hollow teeth for fluid delivery.
Figure 4B:
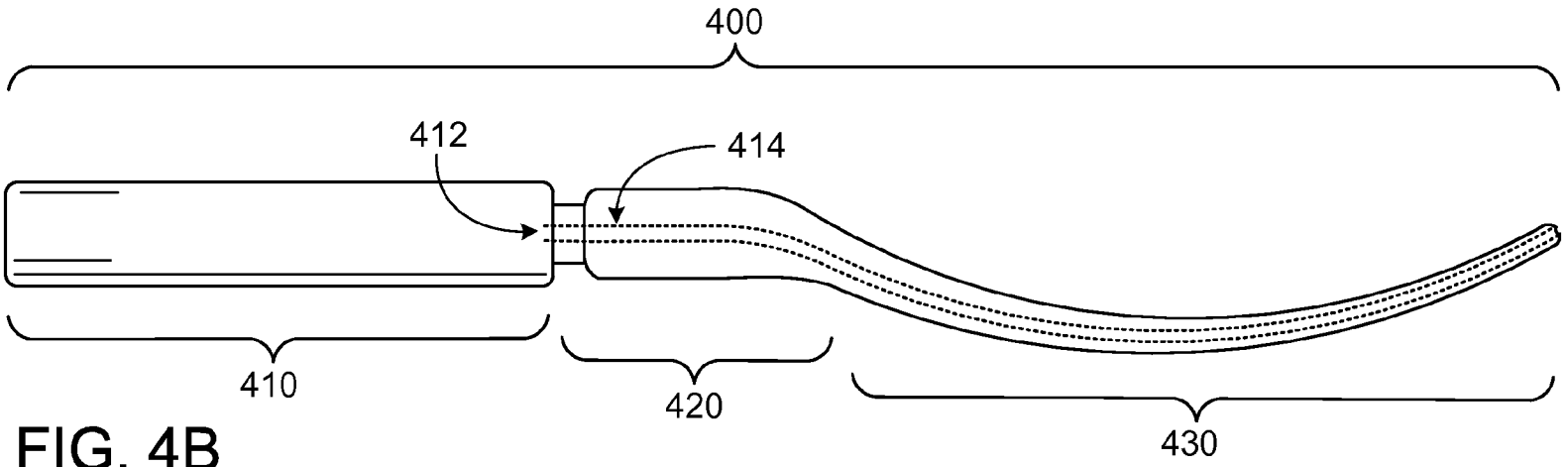
Figure 4C:
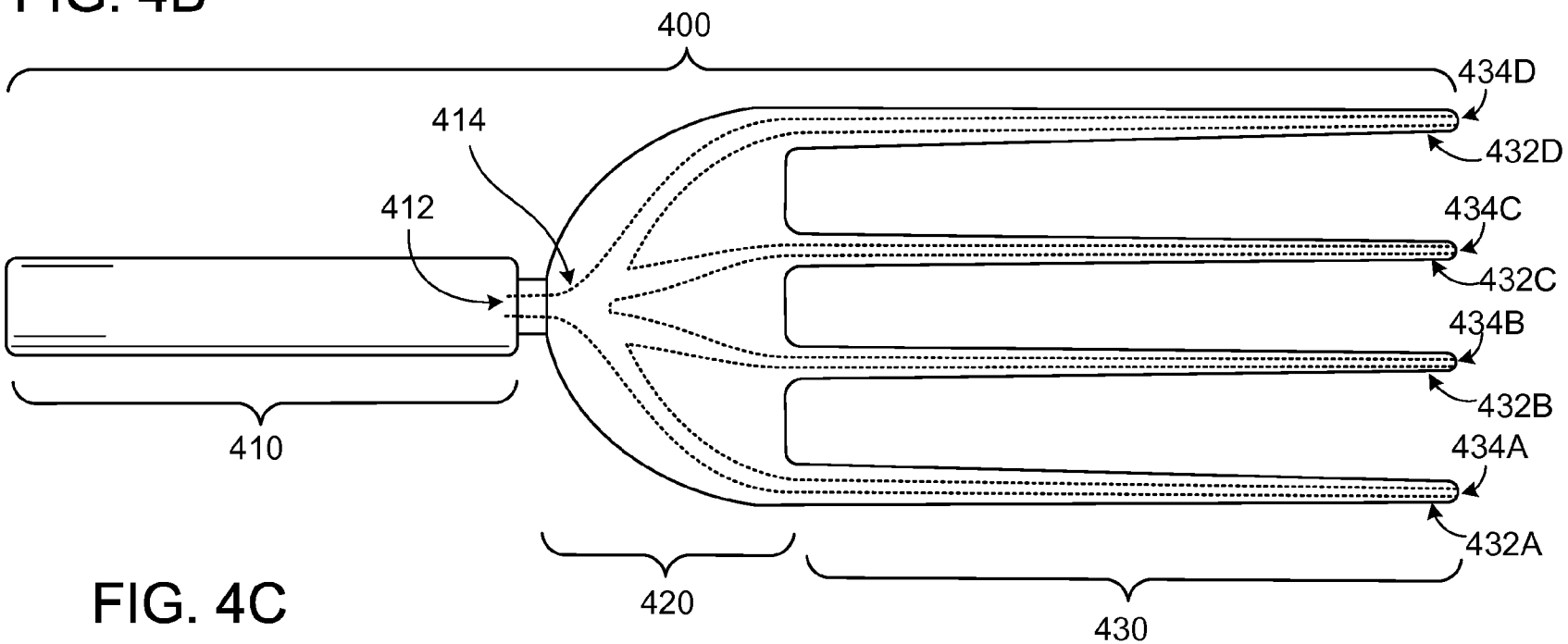

FIGS. 4A-4C are three views that illustrate a scalp care device with curved, hollow teeth for fluid delivery.

Scalp care device 400 is similar to scalp care device 300 from FIGS. 3A-3C in many ways, but it includes additional design features that provide additional functionality. Scalp care device 400 contains three main parts that are analogous to those of FIGS. 3A-3C, including a handle portion 410, a bridge portion 420, and a tooth portion 430. Handle portion 410, bridge portion 420, and tooth portion 430 may vary from embodiment to embodiment as discussed in connection with various embodiments related to FIGS. 3A-3C. However, scalp care device 400 is designed not only to stimulate the user's scalp by moving the tips of the teeth against the scalp, but also to convey fluid to the user's scalp.

This fluid is contained in a cavity in the interior of handle portion 410. For example, the fluid may be a cleaning, soothing, or moisturizing fluid that needs to be applied directly to the user's scalp. In the context of scalp care device 400, handle portion 410 is essentially a bottle that also serves as a grip. Handle portion is portrayed in FIGS. 4A-4C as a circular bottle. However, handle portion may be any other shape, such as a rectangular prism or bottle with a contoured grip. However, the embodiment presented in FIG. 4A-4C is not compatible with a handle portion 410 that is a flat piece of material, as the embodiment of FIGS. 4A-4C requires a hollow cavity to store the fluid. While FIGS. 4A-4C include only one cavity, it is possible to have multiple cavities, so as to allow a choice of fluid, a mixture of fluids, or both.

FIGS. 4A-4C illustrate an aperture 412 at one end of handle portion 410 that allows the fluid to pass into a hollow branch portion 414 that is present in the interior of bridge portion 420. The fluid flows from the interior of handle portion 410 through hollow branch portion 414 into tooth portion 430. The fluid diverges through teeth 432A-432D, flowing thorough hollow channels in the teeth and being delivered to the user's scalp through hollow apertures 434A-434D at the tips of the teeth. Thus, teeth 432A-432D act as conduits for the fluid, allowing scalp care device to apply the fluid directly to where it is needed. While it is possible that the fluid will flow spontaneously, if the fluid is not viscous and the scalp care device can cause fluid flow through gravity, some embodiments may be designed to include an adjunct to handle portion to pressurize the fluid to force it through teeth 432A-

432D and so that it is subsequently applied to the user's scalp at hollow apertures 434A-434D.

While this specification contains many specifics, these should not be construed as limitations on the scope of the invention or of what may be claimed, but rather as descriptions of features specific to particular embodiments of the invention. Certain features that are described in this specification in the context of separate embodiments may also be implemented in combination in a single embodiment. Conversely, various features that are described in the context of a single embodiment may also be implemented in multiple embodiments separately or in any suitable subcombination. Moreover, although features may be described above as acting in certain combinations and even initially claimed as such, one or more features from a claimed combination may in some cases be excised from the combination, and the claimed combination may be directed to a subcombination or variation of a subcombination.

Thus, particular embodiments of the invention have been described. Other embodiments are within the scope of the following claims. For example, the devices may include additional parts or omit certain parts, and still remain within the scope of what is claimed.

What is claimed is:

1. A scalp care device comprising:

a handle portion two to five centimeters wide formed of an elongated piece of material, the handle portion being extended along a longitudinal axis of five to ten centimeters in length, and the handle portion including a bulbous region at the end of the handle portion which continues into a second bulbous region before the handle portion joins into a bridge portion five to seven centimeters wide;

a tooth portion, comprising a plurality of teeth, wherein all of the teeth extend along the longitudinal axis, the teeth are curved with a contour that substantially conforms to the curvature of the top of a human head, and the contour facilitates tips of the teeth to contact portions of the scalp of the human head underneath and removed from edges of hair arrangements of natural or artificial hair without disruption of the hair arrangements when the tips of the teeth are slid underneath the edges of the hair arrangements, and wherein the sides of each tooth are rounded to facilitate penetration underneath the edges of the hair arrangements;

the bridge portion, joining the handle portion to the teeth, wherein the bridge portion broadens as it extends, along the longitudinal axis, from the handle portion, wherein each tooth extends a distance from the bridge portion in the direction of the longitudinal axis, and wherein each tooth is at least as long as the handle portion and two to eight millimeters wide where the tooth protrudes from the bridge portion;

a smooth coating applied to the surface of the handle portion, tooth portion, and bridge portion to improve the tooth portion sliding underneath the edges of the hair arrangements.

2. The device of claim 1, wherein the handle portion and the bridge portion are formed of a single, continuous planar piece of material.

3. The device of claim 1, wherein all of the teeth are substantially parallel.

4. The device of claim 1, wherein the teeth are separated by gaps such that the teeth are substantially narrower than the gaps.

5. The device of claim 1, wherein the material used in the handle portion, the bridge portion, and the tooth portion is all of approximately the same thickness and that thickness is approximately the same as the width of the teeth.

6. The device of claim 1, wherein the tips of the teeth are narrower than the width of the teeth at the points from which the teeth extend from the bridge region.

7. The device of claim 1, wherein the curvature of each tooth is substantially similar to an elliptical arc, wherein a major axis of the elliptical arc is oriented in the direction of the teeth.

8. The device of claim 1, wherein the curvature of each tooth is substantially similar to a truncated elliptical arc, wherein a major axis of the elliptical arc is oriented in the direction of the teeth.

9. The device of claim 1, wherein the teeth are curved such that ends of the teeth are positioned above a plane of the bridge portion and the handle portion.

10. The device of claim 1, wherein the teeth are curved such that ends of the teeth are positioned at or below a plane of the bridge portion and the handle portion.

11. The device of claim 1, wherein the device has an axis of symmetry in a middle of the device that is parallel to the direction in which the teeth extend from the bridge portion.

12. The device of claim 1, wherein portions of the scalp include central portions of the scalp.

13. A scalp care device for manipulating the scalp of a user in a therapeutic manner, comprising:

a handle portion two to five centimeters wide formed of an elongated, flat piece of material extended along a longitudinal axis of five to ten centimeters in length, and the handle portion including a bulbous region at the end of the handle portion which continues into a second bulbous region before the handle portion joins into a bridge portion five to seven centimeters wide, and the handle portion being shaped to be held by one hand of a user;

the bridge portion, extending from the handle portion, wherein the bridge portion broadens as it extends from the handle portion, the bridge portion being formed of a flat piece of material that is in the same plane as the handle portion, the bridge portion extending beyond the grip of a user when a user holds the device by the handle portion; and a tooth portion, extending from the bridge portion and comprising a plurality of non-metallic teeth, wherein the teeth are curved with a contour that substantially conforms to the curvature of the top of a human head and the contour facilitates tips of the teeth to contact portions of the scalp of the user underneath and removed from edges of hair arrangements of natural or artificial hair without disruption of the hair arrangements when the tips of the teeth are slid underneath the edges of the hair arrangements, wherein the sides of each tooth are rounded to facilitate penetration underneath the edges of the hair arrangements, wherein each tooth extends a distance from the bridge portion in the direction of the longitudinal axis, and wherein each tooth is at least as long as the handle portion and two to eight millimeters wide where it protrudes from the bridge portion; and a smooth coating applied to the surface of the handle portion, tooth portion, and bridge portion to improve the tooth portion sliding underneath the edges of the hair arrangements.

14. The device of claim 13, wherein the teeth are positioned to stimulate the scalp of the user to relieve irritation when slid underneath the edges of the hair arrangements.

15. The device of claim 14, wherein portions of the scalp of the user include central portions of the scalp of the user.

16. The device of claim 13, wherein the tips of the teeth are rounded to facilitate penetration by the teeth underneath the edges of the hair arrangements.

17. The device of claim 13, wherein the teeth are tapered to facilitate penetration by the teeth underneath the edges of the hair arrangements.

18. The device of claim 13, wherein width of the teeth and gaps between teeth are sized to facilitate penetration by the teeth underneath the edges of the hair arrangements.

19. A scalp care device comprising:

a handle portion two to five centimeters wide formed of an elongated piece of material, the handle portion being extended along a longitudinal axis of five to ten centimeters in length, and the handle portion joining into a bridge portion five to seven centimeters wide, the handle containing a cavity that is filled with a liquid to be conveyed to a user's scalp;

a tooth portion, comprising a plurality of non-metallic teeth, wherein all of the teeth extend along the longitudinal axis, the teeth are curved with a contour that substantially conforms to the curvature of the top of a human head, and the contour facilitates tips of the teeth to contact portions of the user's scalp underneath and removed from edges of hair arrangements of natural or artificial hair without disruption of the hair arrangements when the tips of the teeth are slid underneath the edges of the hair arrangements, the teeth are hollow, the tips of the teeth have openings, and the sides of each tooth are rounded to facilitate penetration underneath the edges of the hair arrangements;

the bridge portion, joining the handle portion to the teeth, wherein the bridge portion broadens as it extends, along the longitudinal axis, from the handle portion, wherein the bridge portion contains an orifice that allows fluid from the cavity to flow through the orifice through the openings at the tips of the teeth, and wherein each tooth extends a distance from the bridge portion in the direction of the longitudinal axis, and wherein each tooth is at least as long as the handle portion and two to eight millimeters wide where the tooth protrudes from the bridge portion; and a smooth coating applied to the surface of the handle portion, tooth portion, and bridge portion to improve the tooth portion sliding underneath the edges of the hair arrangements.

20. The device of claim 19, wherein portions of the user's scalp include central portions of the user's scalp.

* * * * *